US005440470A

United States Patent [19]

Ly

[11] Patent Number: 5,440,470

[45] Date of Patent: Aug. 8, 1995

[54] FLOATING REFLECTOR ASSEMBLY FOR A LIGHTING FIXTURE

[75] Inventor: Hue Ly, Richmond, Calif.

[73] Assignee: Peerless Lighting Corporation, Berkeley, Calif.

[21] Appl. No.: 904,441

[22] Filed: Jun. 25, 1992

[51] Int. Cl.[6] ..... F21S 3/00

[52] U.S. Cl. ..... 362/341; 362/217; 362/148; 362/306; 362/364; 362/433; 248/231.8

[58] Field of Search ..... 362/217, 148, 260, 296, 362/306, 341, 364, 365, 433; 248/231.8, 316.7

[56] References Cited

U.S. PATENT DOCUMENTS

| | | | |
|---|---|---|---|
| 2,541,828 | 2/1951 | Peck | 248/316.7 |
| 2,740,735 | 4/1956 | Swain | 248/316.7 |
| 3,029,057 | 4/1962 | Ferm | 248/316.7 |
| 3,047,648 | 7/1962 | Mowatt | 248/316.7 |
| 3,807,319 | 4/1974 | Steanson, Jr. | 248/231.8 |
| 4,636,926 | 1/1987 | Roberge | 362/433 |
| 4,814,954 | 3/1989 | Spitz | 362/217 |
| 4,874,977 | 10/1989 | Safranek | 248/231.8 |
| 4,894,882 | 1/1989 | Boyd | 248/316.7 |
| 4,896,858 | 1/1990 | Sokolski et al. | 248/231.8 |
| 4,928,209 | 5/1990 | Rodin | 362/217 |
| 4,971,280 | 11/1990 | Rinderer | 248/231.8 |
| 5,072,350 | 12/1991 | Lowell et al. | 362/18 |

*Primary Examiner*—Ira S. Lazarus
*Assistant Examiner*—Sara Sachie Raab
*Attorney, Agent, or Firm*—Donald L. Beeson

[57] ABSTRACT

A luminaire, such as an indirect linear luminaire, is provided with a floating reflector assembly tied directly to securement points in the luminaire housing. The reflector assembly has a reflector element with tie down openings which overlay the reflector securement points and compliant spring-like retaining clips which overlap the tie down openings and which are secured at their center portion to the underlying securement points by a screw fastener. The width of the retaining clips are narrower than the tie down opening such that the center portion of the retaining clips can be drawn into and contact the housing securement points to provide good electrical grounding. The pressure contact of the retaining clips holds the reflector down yet permits it to float within the housing when the housing is distorted, such as by twisting, thereby avoiding distortion of the reflector.

19 Claims, 4 Drawing Sheets

FLOATING REFLECTOR ASSEMBLY FOR A LIGHTING FIXTURE

BACKGROUND OF THE INVENTION

The present invention generally relates to architectural lighting fixtures; it more particularly relates to reflector systems for lighting fixtures and the hardware used for mounting reflectors in a fixture housing. The invention has specific application in the field of linear lighting wherein elongated linear fixture elements of varying lengths have extruded aluminum housings that are subject to bending and twisting during installation. While the invention is particularly suited and is described herein in reference to linear indirect lighting fixtures, it shall be understood that the invention can also be used with linear fixture elements for direct lighting.

The fixture elements of a linear lighting system, be it a direct or indirect lighting system or a combination of both, are typically suspended from an overhead ceiling by means of suspension media such as flexible aircraft cable or rigid stems. During installation, each fixture is normally held at its extreme ends while installers attach the suspension media to connecting hardware in the fixture housing or while the fixture is attached to other suspended elements of the lighting system. Since fixture housings are typically fabricated of relatively flexible extruded aluminum, they can easily be twisted out of shape during this installation procedure. For long fixture lengths this twisting can be quite severe.

In older fixture designs, twisting of the housing during installation has not been a particular problem in that the deformed housing could be restored to its original undeformed condition by installers at the job site by applying a simple counter-twisting force to the fixture ends. However, restoration of the housing to its original shape cannot be readily achieved in certain newer reflector and lamp socket mounting configurations. The problem arises in the way the reflector in these newer configurations are mounted. In older designs, the reflectors are attached to the fixture's housing by means of socket saddles, which are relatively flexible bent metal parts which provide a stand-off for the reflector. In contrast, the approach of more recent fixture designs is to mount the reflector directly to the housing, thereby eliminating the need and extra cost of socket saddles. However, by eliminating socket saddles, the reflector now has greater direct contact with the fixture housing with the result that any distortion by twisting of the elongated housing will tend to cause a greater degree of deformation in the reflector than would be the case if socket saddle supports were used. Since the reflector and housing are typically fabricated of different metals, sheet steel in the case of the reflector and extruded aluminum in the case of the housing, and because steel is less flexible than aluminum, the consequence of deforming the reflector along with the housing is that the reflector will act to hold the housing in its deformed condition making it difficult to restore it to its original shape. The result often is that the fixtures, when installed, are permanently and noticeably twisted, detracting from their appearance. This problem is particularly noticeable in linear lighting systems which have long runs of linear elements designed to provide an attractive architectural feature to an interior space.

The present invention overcomes the problem of permanent deformation of a linear lighting fixture having a reflector assembly attached directly to the fixture's extruded aluminum housing. Using the present invention, a linear lighting fixture having such a reflector assembly can, when initially twisted during installation, be easily restored by a counter twisting force to its original shape.

SUMMARY OF THE INVENTION

Briefly, the invention involves a floating reflector assembly for a luminaire which permits the reflector to be tied directly to the luminaire housing while permitting the reflector to move relative to the housing when the housing is distorted, such as by twisting. In accordance with the invention, when the housing of a linear lighting fixture element is twisted, the reflector mounted internally of the housing will move or float at its mounting or securement points to prevent any substantial bending of the reflector. Similarly, the reflector will float within the housing when a counter twisting force is applied for restoring the housing to its original shape. Thus, it will be seen that the reflector can be tied directly to the housing without creating a condition where the housing is permanently distorted by twisting during installation.

The reflector assembly of the invention is comprised of a reflector element having over-sized tie down openings at locations where the openings overlay reflector securement points formed in the fixture housing. In the illustrated embodiment reflector securement points are provided by screw channels formed in the fixture housing side walls; however, it will be appreciated that the reflector could otherwise be secured directly to the housing such as by means of discrete tapped or untapped screw holes. The reflector is tied down to its securement points by means of retaining clips, each of which has a center portion and extended end portions, and each of which is suitably sized such that its extended end portions overlap the tie down opening so as to contact top surface portions of the reflector element. Each of the retaining clips is attached and drawn to its securement point by fastening means such as metal tie down screws inserted through a fastener opening in the center portion of the retaining clip. The width of the center portion of the retaining clip is preferably sized such that it can be drawn into the tie down opening to contact the underlying housing securement point to provide a good electrical ground.

Preferably, the extended ends of the retaining clips have downwardly projecting edges which provide an edge contact with the top surface of the reflector element for biting into this surface and, again, for providing good electrical contact for grounding purposes. The edge contact raises the extended ends of the retaining clips off of the reflector at the edges of the tie down openings so that contact between the reflector and downwardly projecting edges is not lost when the center of the retaining clip is depressed. The spring pressure of the clip's extended ends against the reflector act to hold the reflector in position while permitting its lateral movement beneath the clip. The reflector surface underlying the contact points of the retaining clips are preferably flat surfaces that will not hang up or bind on the clip, however, it is contemplated that the retaining clips could as well be used over irregular surfaces such as a Hammertone reflector.

A guide tab can alternatively be provided on one longitudinal side of the center portion of the retaining clip to assist in the proper positioning of the retaining clip during assembly. This alternative feature is particularly useful in lensed indirect linear lighting fixtures where a lens is placed on top of the fixture's reflector to receive and diffuse or redirect source light and where it is necessary to leave an unobstructed narrow flat seating area on the bottom reflector plate for the bottom edge of the lens. More specifically, guide tabs can be used to precisely align the retaining clips relative to an abutment structure (such as a turned up side wall portion of the reflector) to provide the requisite unobstructed flat area between the abutment structure and the edge of the retaining clips. The guide tab itself will not obstruct this area since it is designed to disappear into the tie down opening when the center portion of the retaining clip is depressed.

Therefore, the primary object of the present invention is to provide a reflector assembly and retaining clip therefor which permit a reflector attached directly to the luminaire housing to float within the luminaire housing such that the reflector does not deform when the housing is deformed. It is a further object of the invention to provide a floating reflector assembly which has relatively inexpensive parts and which can be easily installed. The reflector assembly of the invention also provides, in an indirect luminaire, a way of readily installing the reflector assembly's retaining clips so as to leave a properly dimensioned flat mounting surface along the edge of the reflector for receiving the mounting edges of a lens element. Still other objects of the invention will become apparent from the following specification and claims.

DESCRIPTION OF THE DRAWINGS

FIG. 2 additionally shows a lens installed on the luminaire over the luminaire's reflector and light source.

DETAILED DESCRIPTION OF THE ILLUSTRATED EMBODIMENT

Figure 1:
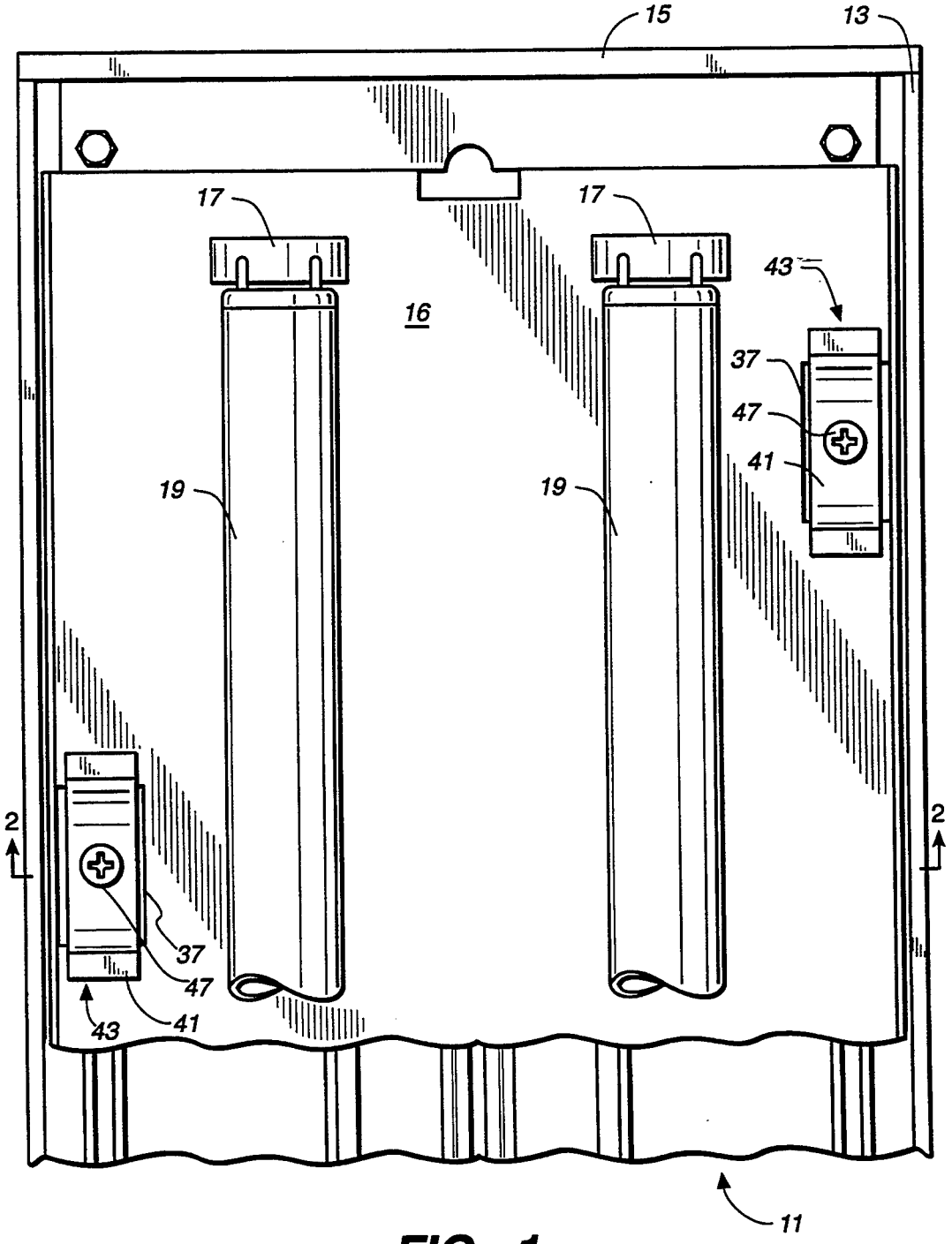
FIG. 1 is a fragmentary top plan view showing a partial length of an indirect luminaire with a floating reflector assembly in accordance with the invention.
Figure 2:
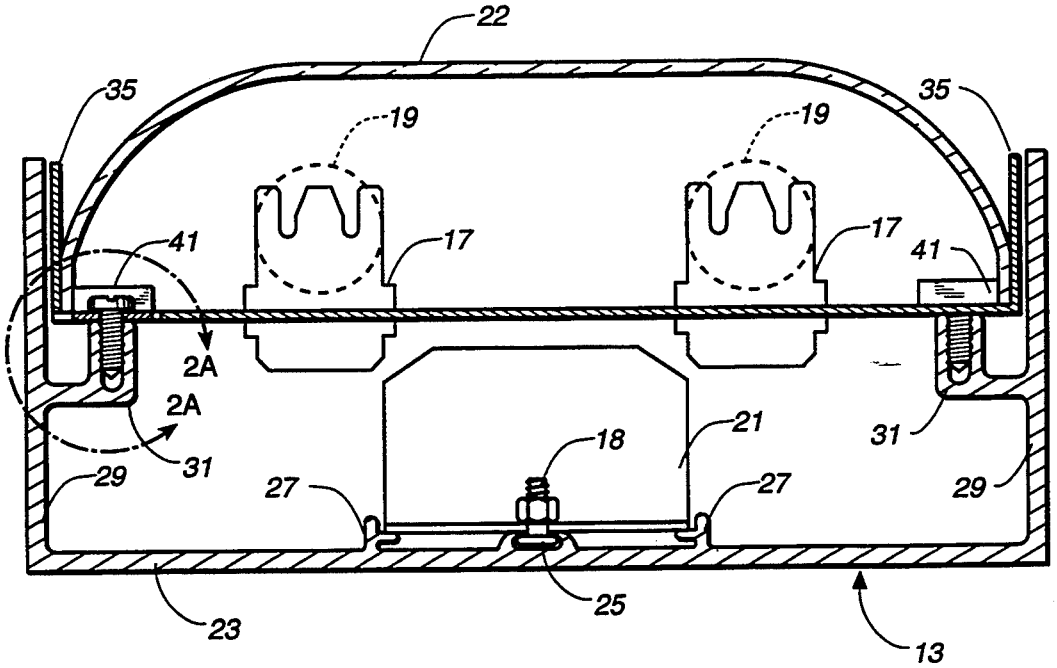
FIG. 2 is a cross-sectional view in side elevation of the luminaire and floating reflector assembly of FIG. 1 taken along section lines 2—2.
Figure 2A:
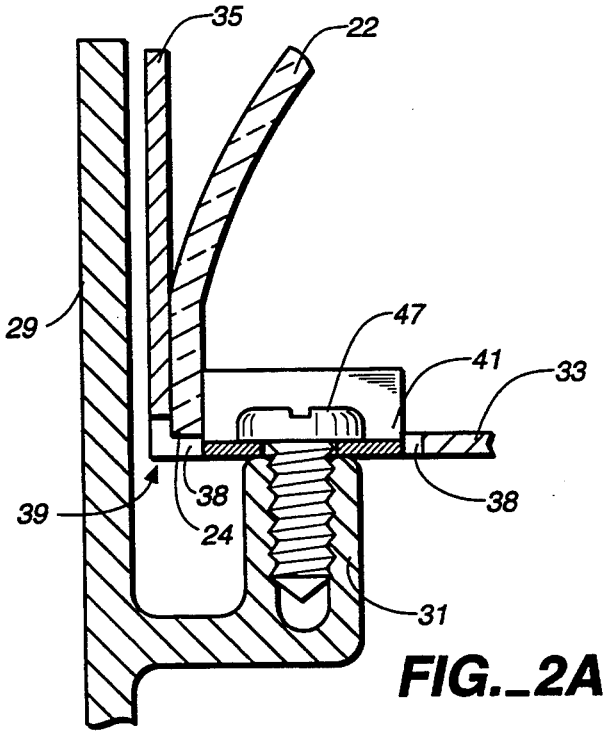
FIG. 2A is an enlarged fragmentary view in cross-section of the detail of the structure shown at lines 2A—2A of FIG. 2.

Referring now to the drawings, FIGS. 1, 2, and 2A generally show the construction of the end portion of a linear indirect lighting fixture 11 having a floating reflector assembly in accordance with the invention. The fixture, which extends in a uniform cross-sectional shape and a generally uniform configuration for a designated fixture length, typically in incremental lengths of between four and twenty-four feet, includes the following basic elements: an elongated housing 13, preferably an extruded aluminum housing terminated by end caps such as end cap 15, preferably fabricated of cast aluminum; a reflector element 16 fabricated of bent sheet metal, suitably pre-painted white cold rolled steel; lamp sockets 17 suitably attached such as by screw or snap-in attachments, directly to the reflector element for holding fluorescent lamps 19; a ballast 21 installed in the housing below the reflector; and a lens cover 22 (shown in FIGS. 2 and 2A only). The ballast and lamp sockets are wired to external a.c. power in a manner well-known in the art.

The extruded fixture housing includes a bottom wall 23 and side walls 29. Ballast support ribs 27 formed on the inside surface of the housing bottom wall support the ballast 21 such that the ballast can be secured in a fixed position by anchor screws 18 which engage central T-slot 25. Opposed parallel screw channels 31 are further formed on the interior surfaces of the housing side walls so as to provide a support structure for the reflector element 16. The housing walls, ballast support ribs, T-slot and screw channels are all seen to be part of a single extrusion.

The reflector element includes a bottom plate 33 and upturned vertical side walls 35 which provide an abutment structure for mounting edges 24 of lens 22 which is placed over the reflector to cover the fixture's light source, i.e., fluorescent lamps 19. It can be seen that the reflector element is sufficiently wide to span the housing screw channels 31 and to be supported thereby.

A plurality of rectangular tie down openings 37 are located along the side edges 39 of the reflector's bottom plate 33 adjacent the reflector's vertical side walls so as to overlay the screw channels 31 which support the reflector. The fragmentary view of FIG. 1 shows two such tie down openings suitably located on opposite sides of the reflector. It will be understood that tie down openings would preferably be spaced uniformly along the edges of the reflector for the length of the fixture, with a number of tie down openings depending on the fixture's overall length.

Figure 3:
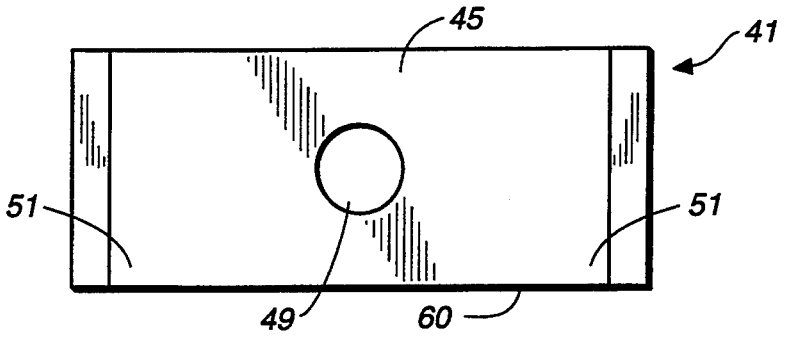
FIG. 3 is a top plan view of a retaining clip for a floating reflector assembly in accordance with the invention.
Figure 4:
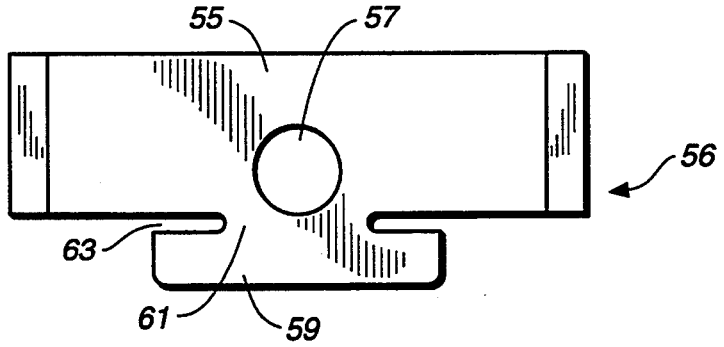
FIG. 4 is an alternative embodiment of a retaining clip for a floating reflector assembly in accordance with the invention.
Figure 5:
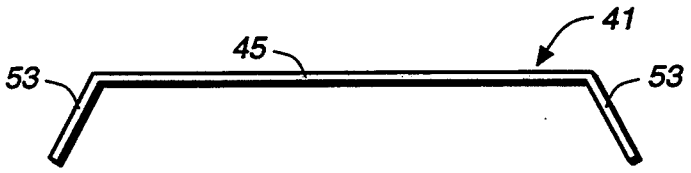
FIG. 5 is a side elevation view of the retaining clip shown in FIG. 3.

The reflector element is held to the screw channels at the tie down opening by means of retaining clips 41, alternative embodiments of which are illustrated in FIGS. 3 and 4. The retaining clips are compliant spring-like clips, preferably made of stainless steel, which provide a pressure contact on the top surface of the reflector at flat surface portions 43 adjacent the tie down openings. Referring to the embodiment of the retaining clip shown in FIGS. 2A and 3, it is generally seen that the retaining clips each have a center portion 45 which is narrower in width than the width of the tie down opening so that the center of the clip can be drawn into the tie down opening by fastening means such as tie down screws 47 which insert through a fastener opening 49 and which tap into one of the relatively soft extruded aluminum screw channels 31. The retaining clips further include extended end portions 51 which overlap the tie down opening. As generally shown in FIGS. 5 and 6, the extended end portions of the retaining clip have inwardly bent edges 53 which, in its undeformed condition, gives the clip a generally inverted U-shape which can be depressed inwardly by the tie down screw 47*a* as shown by the phantom lines in FIG. 6.

Figure 6:
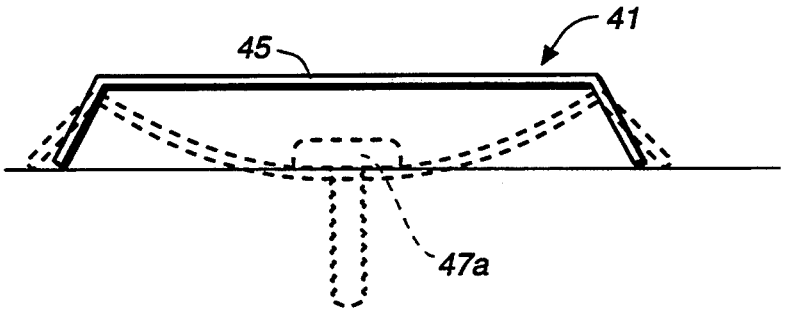
FIG. 6 is a side elevation of the retaining clip shown in FIG. 3 with the deformed position of the retaining clip shown in phantom lines.

As best shown in FIG. 2A and FIG. 6, when the center portion 45 of the retaining clip is screwed entirely down onto the top of supporting screw channels 31 to make contact therewith, the center of the clip actually extends into the tie down opening 37. Consequently, it is important that, as above mentioned, the retainer strip be narrower than the relatively speaking oversized tie down opening to provide spaces 38 between the side edges of the retaining clips and the tie down opening boundaries such that the depressed center of the retaining clip does not inhibit lateral movements of the reflector on the screw channels. Also, during installation, it is necessary to precisely space the retaining clip away from the reflector's side walls 35 to permit the lens' bottom mounting edges 24 to properly seat on top of the bottom plate of the reflector element inside of the side walls. To permit quick installation of a precisely aligned retainer clip, an alternative embodiment of the retaining clip having a guide tab can be provided as shown in FIG. 4.

Referring to FIG. 4, the retaining clip 56 is generally seen to have a center portion 55, a fastener opening 57, and a relatively elongated guide tab 59 attached to one of the longitudinal sides 60 of the clip's center portion by means of a relatively narrow neck portion 61 which is created by the inwardly extending slots 63 between the tab and the body of the retaining clip. By providing a relatively narrow neck attachment between the tab and the body of the retaining clip, the tab will tend to lay flat when the clip is deformed. This prevents the tab from projecting out of the tie down opening where it can unseat the lens.

Figure 7:
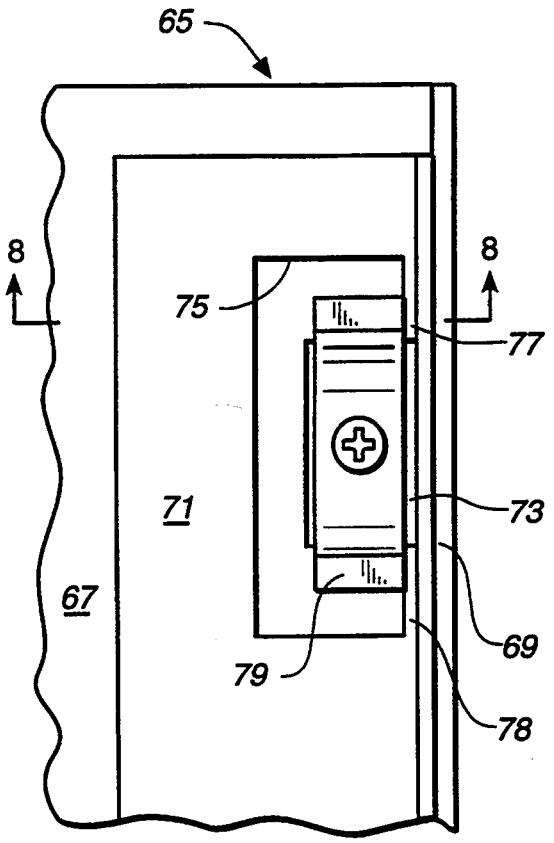
FIG. 7 is a fragmentary top plan view of an alternative embodiment of the invention wherein a second reflector having a cut-out over the bottom reflector's tie down opening provides for proper alignment of the retaining clips of the invention.
Figure 8:
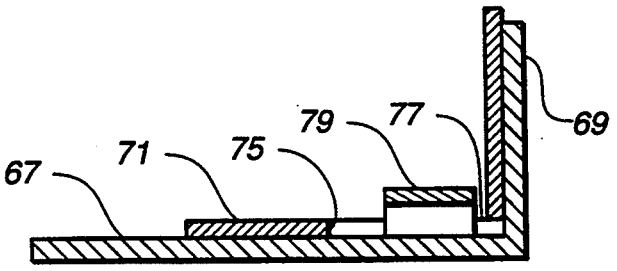
FIG. 8 is a side elevational view in cross-section of the embodiment of the invention shown in FIG. 8 taken along section lines 8—8.

FIG. 7 shows an alternative embodiment of the invention wherein alignment of the retaining clip over its tie down opening is facilitated, instead of by a guide tab, by means of a guiding structure which is part of the reflector element itself. Specifically, the embodiment of FIG. 7 shows a reflector element 65 comprised of a base reflector material 67 having an upturned sidewall 69 and a separate top reflecting material 71 overlying the base reflecting material and suitably attached thereto such as by crimp connections or by gluing the parts together. The base reflector material in this embodiment would suitably have a diffuse white reflecting surface while the top reflector material can suitably be a specular reflector material such as alzak TM.

The base reflector material of the reflector element shown in FIG. 7 is further seen to have a tie down opening 73 adjacent the bottom reflector material's upturned wall 69 whereas the top reflector material is provided with a larger overlapping opening 75 formed in part by inwardly projecting edge structures 77, 78 against which the retaining clip 79 can be made to abut when the retaining clip is placed over the tie down opening 73 in contact with the surfaces of the base reflector material 67. The width of the inwardly projecting edges 77, 78 is chosen to space the retaining clip a desired distance from the upwardly turned sidewall 69 of the base reflector material. Thus, in the FIG. 7 embodiment, a retaining clip without a guide tab such as shown in FIG. 4 can readily and quickly be placed over the tie down opening at a precise spacing that accommodates the lens.

The reflector assembly described herein, that is the assembly comprised of the described and illustrated, reflector element, lamp sockets, retainer clips, and tie down screws is easily installed by first placing the reflector element with attached lamp sockets onto the supporting screw channels 31 in the fixture housing while properly locating the reflector along the length of the housing. Then, after placing retaining clips over each of the tie down openings in the reflector element, the retaining clips can then be fastened to the supporting screw channels in the housing by means of the tie down screws which are advanced until the center portion of the retaining clips contact the tops of the screw channels. The spring tension created in the extended ends of the retaining clips will securely hold the reflector element onto the screw channels and will provide good electrical contact between the reflector and the housing so that the reflector assembly can be properly grounded. It will be understood that proper grounding can be achieved by ways other than through the screw attachment of the retaining clips, such as, for example, by providing for a separate grounding strap between the reflector and the housing. Such a grounding strap would permit the retaining clips to be fabricated of a non-conductive material such as plastic.

Although the present invention has been described in considerable detail in the foregoing specification, it is understood that it is not intended that the invention be limited to such detail, except as necessitated by the following claims.

What I claim is:

1. A floating reflector assembly for a luminaire housing, having reflector securement points comprising a reflector element having tie down openings and top surface portions adjacent said tie down openings, said tie down openings being formed in said reflector element at locations where the tie down openings will overlay the reflector securement points in said luminaire housing, retaining clips for the tie down openings of said reflector element, each of said retaining clips having a center portion and extended end portions, said extended end portions being formed to overlap the retaining clip's corresponding tie down opening so as to contact the top surface portions of said reflector element, and fastening means for each of said retaining clips for fastening the center portion of said retaining clip to a reflector securement point of said luminaire housing through a corresponding reflector tie down opening and for drawing said center portion inwardly relative to the top surface portions of said reflector element so as to create a floating pressure contact between the extended ends of said retaining clip and the top surface portions of said reflector element.

2. The floating reflector assembly of claim 1 wherein the reflector top surface portions contacted by the extended ends of said retaining clips are flat surfaces which permit the reflector to readily float in lateral directions relative to said pressure contact.

3. The floating reflector assembly of claim 1 wherein the tie down openings and the center portion of said retaining clip have defined widths and the width of the center portion of said retaining clip is narrower than the width of the retaining clip's corresponding tie down opening such that said center portion can be drawn down into said tie down opening to contact the reflector securement points of said housing.

4. The floating reflector assembly of claim 1 wherein at least one of the extended ends of said retaining clip has an inwardly projecting edge for providing an edge contact with the top surface portions of said reflector element.

5. The floating reflector assembly of claim 1 wherein said retaining clips are formed of a strip of compliant material the extended ends of which exert a spring-like contact with the top surface portions of said reflector element when the center portion thereof is drawn inwardly relative to the top surface portions of said reflector.

6. The floating reflector assembly of claim 5 wherein the extended ends of said compliant material are bent inwardly for providing an edge contact with the top surface portions of said reflector element.

7. The floating reflector assembly of claim 5 wherein said compliant material is stainless steel.

8. The floating reflector assembly of claim 1 wherein said fastening means includes a fastener hole in the center portion of said retaining clip and a threaded fastener insertable therethrough for threadedly fastening said center portion to the reflector securement points of said housing.

9. The floating reflector assembly of claim 1 wherein the tie down openings are formed in said reflector immediately adjacent an abutment structure and wherein the center portion of said retaining clip has defined longitudinal sides and a guide tab extends from one of the sides of said center portion such that the guide tab, when placed against said abutment structure, will act to space said retaining clips over said tie-down openings in fixed spaced relationship to said abutment structure.

10. The floating reflector assembly of claim 9 wherein said guide tab has a relatively narrow neck portion for attaching said guide tab to the center portion of said retaining clip such that deformation of the center portion of said retaining clip will act to draw said guide tab into said tie-down opening without substantially deforming said guide tab.

11. The floating reflector assembly of claim 10 wherein said reflector element includes a bottom plate and vertical upturned side walls formed on the longitudinal edges of said bottom plate and wherein said tie-down openings extend up to the reflector element's vertical side walls which acts as the abutment structure for said guide tab.

12. The floating reflector assembly of claim 10 wherein said guide tab has a defined width and the width of said guide tab is such that a mounting edge of a lens element of a luminaire will seat across said tie-down opening between the center portion of said retaining clip and said abutment structure.

13. A floating reflector assembly for an elongated extruded luminaire housing having opposed substantially parallel extruded screw channels which have a defined spacing and which provide reflector securement points, said floating reflector assembly comprising a reflector element having defined side edges and approximately corresponding in width to the spacing between the screw channels in said luminaire housing such that the reflector element can be supported along its side edges by said extruded screw channels, said reflector element having multiple tie down openings formed along its side edges such that the tie down openings overlay said extruded screw channels, compliant retaining clips for the tie down openings of said reflector element, each of said retaining clips having a center portion and extended end portions, said center portion having defined longitudinal sides and said extended end portions being formed to overlap the retaining clip's corresponding tie down opening so as to contact said reflector element, and screw fastening means for each of said retaining clips for fastening the center portion of said retaining clip to a screw channel of said luminaire housing through a corresponding reflector tie down opening and for drawing said center portion inwardly into the tie-down openings of said reflector so as to create a floating pressure contact between the extended ends of said retaining clip and said reflector element.

14. The floating reflector assembly of claim 13 wherein said reflector element has turned-up vertical side walls which act as abutments for said retaining clips and wherein said retaining clips each have a guide tab extending from one of the longitudinal sides of the center portion thereof such that the guide tab, when placed against the side walls of said reflector element, will act to precisely space said retaining clips over said tie-down openings.

15. The floating reflector assembly of claim 14 wherein the guide tab of each of said retaining clips has a relatively narrow neck portion for attaching said guide tab to the center portion of said retaining clip whereby depressing the center portion of said retaining clip will act to draw said guide tab into said tie-down opening without substantially deforming said guide tab.

16. A luminaire comprising an elongated housing having opposed elongated screw channels formed therein, a reflector element spanning and supported by said screw channels, said reflector element having a plurality of tie-down openings overlying said screw channels, a compliant retaining clip for each of said tie-down openings, each of said retaining clips having a center portion with defined longitudinal sides and extended end portions, said extended end portions being formed to overlap the retaining clip's corresponding tie down opening so as to contact said reflector element, and screw fastening means for each of said retaining clips for fastening the center portion of said retaining clip to an underlying housing screw channel through a reflector tie-down opening and for drawing said center portion inwardly into said tie-down opening so as to create a floating pressure contact between the extended ends of said retaining clip and said reflector element.

17. The luminaire of claim 16 wherein said luminaire is an indirect luminaire which further comprises an elongated lens element having bottom mounting edges, an abutment structure in said housing immediately adjacent the tie-down openings of said reflector element, said retaining clips having a guide tab extending from one of the sides of the center portion thereof such that the guide tab when placed against said abutment structure will act to space said retaining clips over said tie-down openings in fixed spaced relationship to said abutment structure and wherein said guide tab is drawn by said screw fastening means into said tie-down opening along with the center portion of said retaining clip, and said lens being mounted in said housing by placing the mounting edges thereof in seating relationship on said reflector element over said retaining clip guide tabs between the extended ends of said retaining clips and said abutment structure.

18. The luminaire of claim 17 wherein said abutment structure for the mounting edges of said lens consist of turned-up vertical side walls on said reflector element.

19. The luminaire of claim 18 wherein said guide tab has a relatively narrow neck portion for attaching said guide tab to the center portion of said retaining clip whereby deformation of the center portion of said retaining clip will act to draw said guide tab into said tie-down opening without substantially deforming said guide tab.

* * * * *